United States Patent [19]

Hildreth

[11] 4,233,786

[45] Nov. 18, 1980

[54] ROOF TILE EDGE COVER

[76] Inventor: Allan B. Hildreth, 78 Marine Parade, Paraparaumu, New Zealand

[21] Appl. No.: 10,841

[22] Filed: Feb. 8, 1979

[30] Foreign Application Priority Data

Feb. 16, 1978 [NZ] New Zealand ..... 186496

[51] Int. Cl.[3] ..... E04D 13/035

[52] U.S. Cl. ..... 52/94; 52/556

[58] Field of Search ..... 52/94, 96, 556

[56] References Cited

U.S. PATENT DOCUMENTS

| | | | |
|---|---|---|---|
| 899,022 | 9/1908 | Benson | 52/94 |
| 1,822,410 | 9/1931 | Macan | 52/96 |
| 2,380,398 | 7/1945 | Booth | 52/96 |

FOREIGN PATENT DOCUMENTS

| | | | |
|---|---|---|---|
| 554823 | 2/1957 | Belgium | 52/96 |

*Primary Examiner*—James L. Ridgill, Jr.
*Attorney, Agent, or Firm*—Haseltine, Lake & Waters

[57] ABSTRACT

A tiled roof (1) has a plurality of rows of overlapping roof tiles (2) secured together along the rows in known manner. At the eaves (5) of the roof (1) the edges (10C) of the respective end tiles are covered over by respective edge covers (8). The covers (8) fulfill the functions of joining the adjacent tile rows together and securing the respective rows to the barge board (6) of the roof (1).

Each cover (8) is one tile length long and has a web (14) of diminishing width with an inturned lip (13) along at least one edge thereof with the larger end (16) of one cover (8) of an upper tile row being slidable over the small end (15) of a second cover of a lower tile row to thus secure adjacent covers (8) together. In one embodiment an inturned lip (13A, 13B) is provided along both edges of the web (14) with the bottom lip (13B) engaging in a downturned lip (20) of a rail (17) secured to the plurality of tiling battens (11) and barge board (6). In another embodiment the rail and cover are combined with the cover (8A) having an outwardly directed rail (31) extending from the bottom edge of its web (14A) to be secured to the tiling battens (11) and barge board (6).

5 Claims, 12 Drawing Figures

Figure 1:
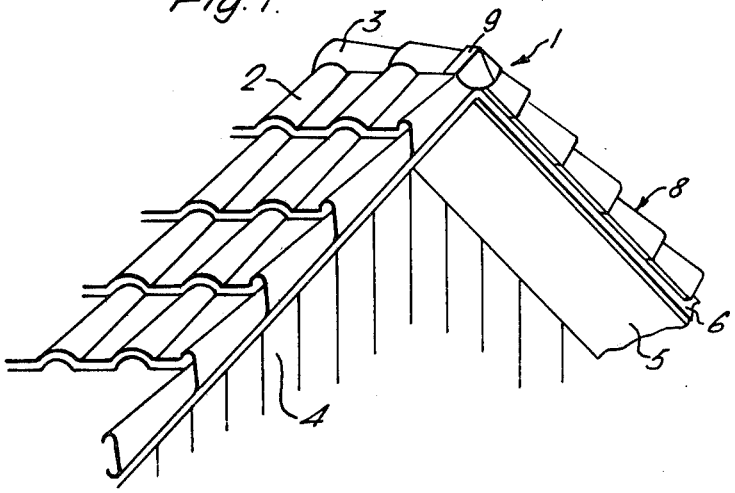

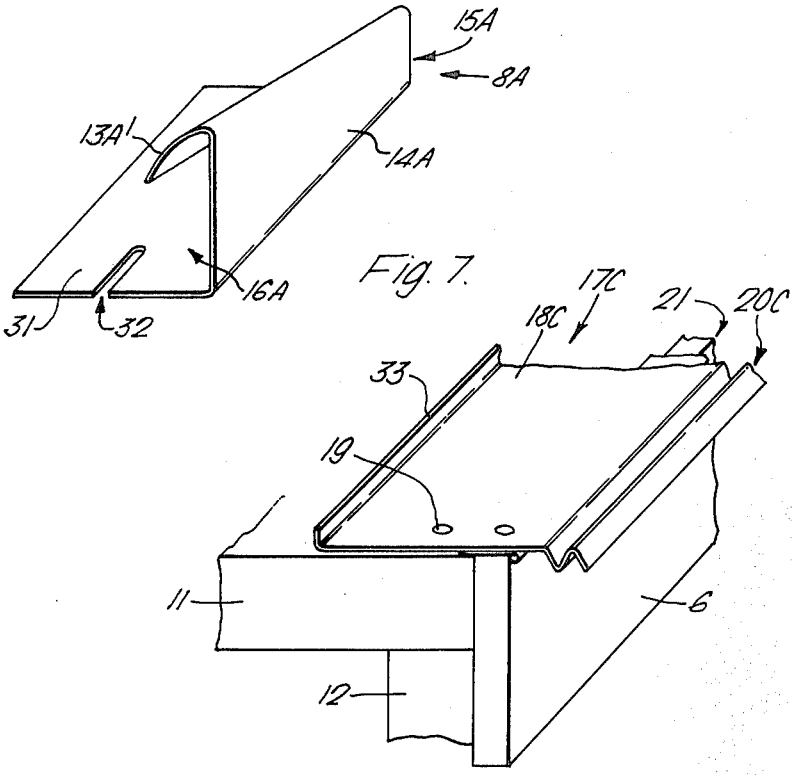
Fig. 7.
Fig. 8.
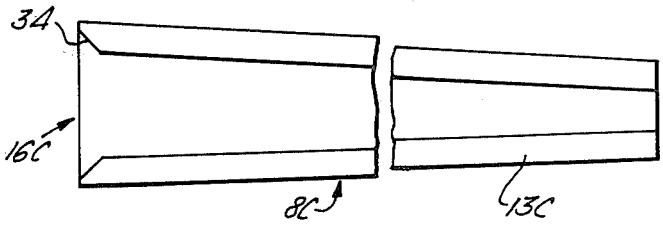

ROOF TILE EDGE COVER

This invention relates to roof tile edge covers for use in the well known types of tiled roofs having a plurality of rows of overlapping roof tiles.

In such tiled roofs a plurality of tiling battens are nailed lengthwise across the rafters and the tiles, which interlink one with the other, are then laid in rows along the tiling battens with projections on their undersurface engaged behind a respective tiling batten to prevent the tile from sliding down the incline of the roof.

At the gable ends of the roof where the roof meets the side walls of the building the end tiles of the respective rows need to be covered over at the same time securing the tile rows together and to the roof structure.

In a previously known system a metal strip has been secured to the tiling batten ends to support a barge mould fitted thereover, further support clips then being securable to the tiling batten to support an elongate tile edge cover known as a dry verge which will extend the length of the gable ends covering over the end tiles of each of the rows of tiles on one side of the tiled roof.

Whilst such previous systems have performed satisfactorily certain disadvantages do arise; for example, in that each tile edge cover will cover over the end tiles of a plurality of rows there will be voids formed where the cover passes over the end tiles of adjacent rows, which voids presenting a danger of water entry into the cover and its associated components and usually requiring the use of internal guttering to take away any rain water which did gain entry. Furthermore such long lengths of tile edge cover covering over the plurality of tile rows can tend to detract from the character of the tiles and the stepped nature of the tile rows as seen from the gable end and moreover such long components can present difficulties in their transportation to the site of their installation and in being handled in assembly once on site.

Additionally, such previous systems have required at least some of the components to be left or right handed and this does of course invariably increase the cost of the system.

It is an object of the present invention to thus provide a roof tile edge cover which goes at least some way towards overcoming the above mentioned disadvantages of previous systems available to the present time.

According to one aspect of the present invention there is thus provided a roof tile edge cover comprising an elongate web of diminishing width along its length having along one edge thereof an inwardly directed lip to engage about a tile edge and defining a large and a small opening at respective first and second ends of said web and securing means provided along an opposite edge of said web to secure said cover to a roof edge, the large opening at the first end of one of said covers being slidable over the edge of an end tile of one row and over the second end of a cover already in position over the edge of an end tile of the adjacent lower row and whereby the said securing means secures respective covers to the roof edge and the interconnection of the respective covers of adjacent rows secures the rows together.

Further aspects of this invention which should be considered in all its novel aspects, will become apparent from the following description, given by way of example of certain embodiments of the invention and in which reference is made to the accompanying drawings, wherein;

FIG. 1: shows a side elevational view at the gable end of one side of a roof.

Figure 2:
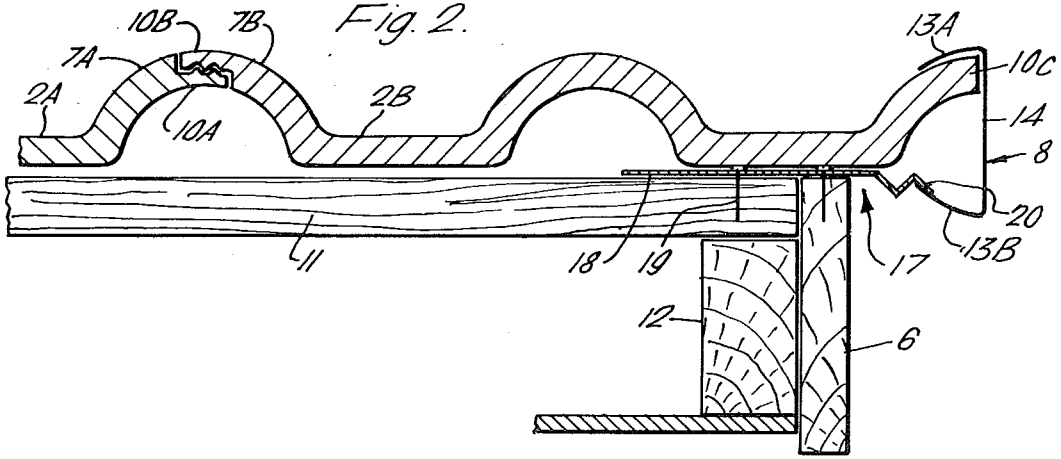

FIG. 2: shows, diagrammatically, a cross-sectional view along the end of one of the rows of roof tiles of FIG. 1.

Figure 3:
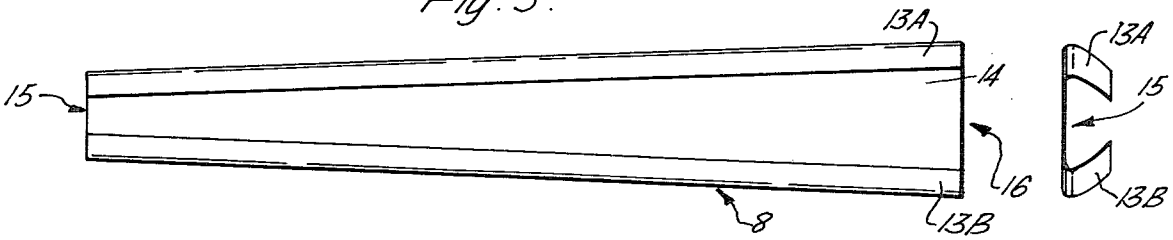

FIG. 3: show a side and an end view of a roof tile edge cover according to one embodiment of the invention.

Figure 4A:
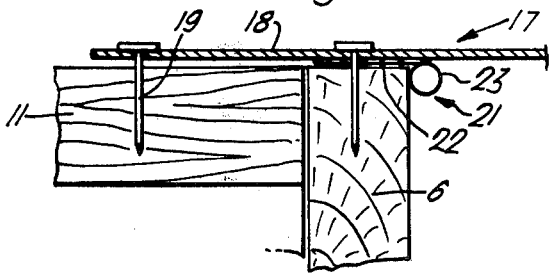
Figure 4B:
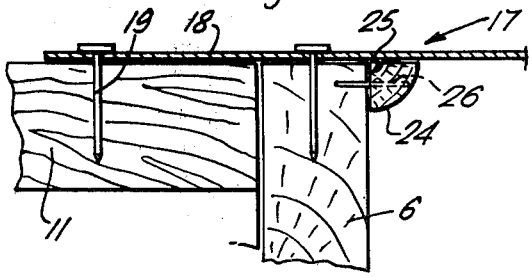

FIG. 4*a*: diagrammatically shows in cross-section one form of waterproofing which may be used in conjunction with the present invention;

FIG. 4*b*: is an alternative embodiment of FIG. 4*a* employing another form of waterproofing.

Figure 5:
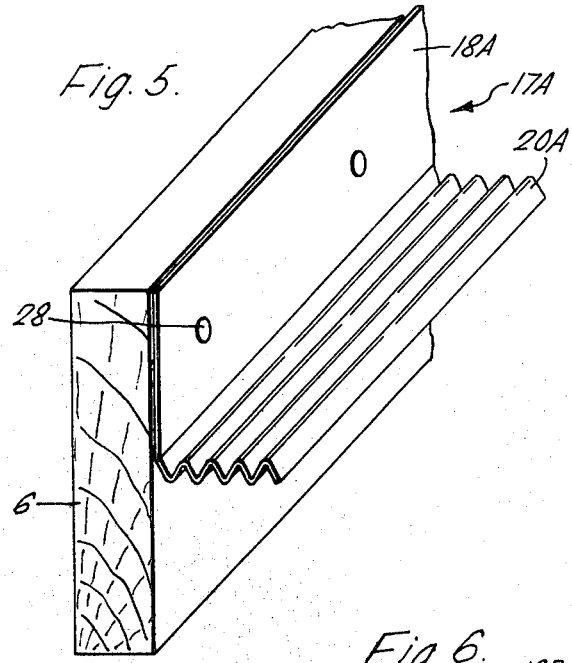

FIG. 5: shows, diagrammatically, an alternative form of rail for use in one embodiment of the present invention.

Figure 6:
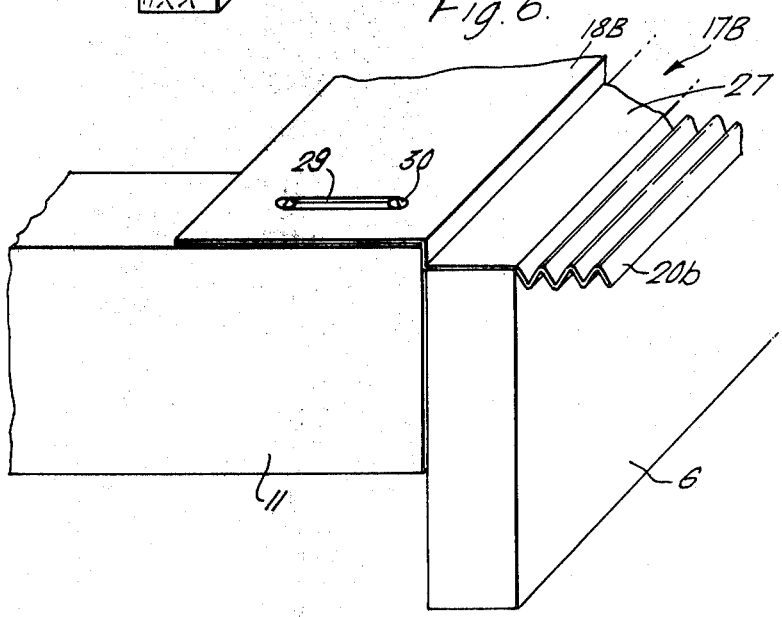

FIG. 6: shows, diagrammatically, another form of rail which may be used in an embodiment of the present invention.

FIG. 7: shows, diagrammatically, an end elevational view of an alternative embodiment of roof tile edge cover.

Figure 9A:
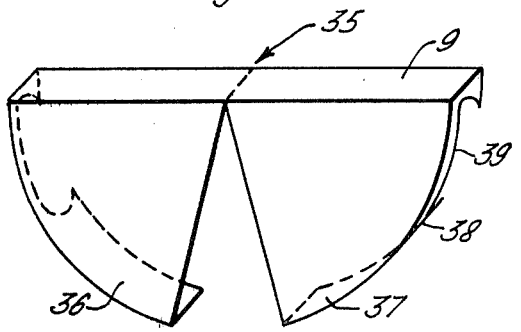
Figure 9B:
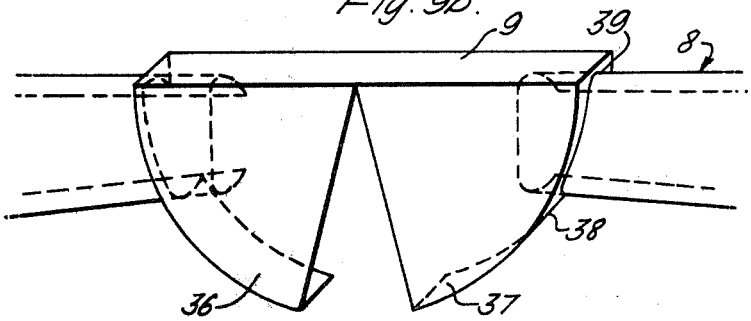
Figure 9C:
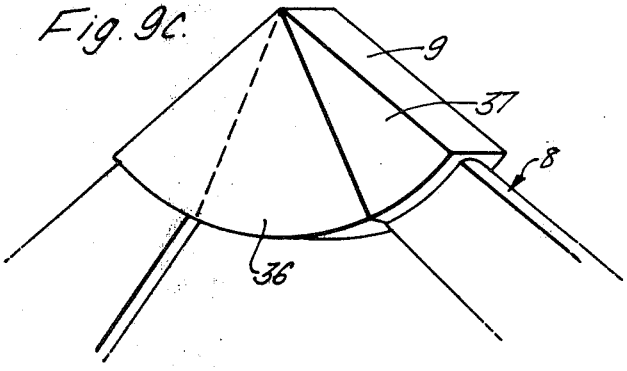

FIG. 8: shows, diagrammatically, alternative forms of a roof tile edge cover and rail for use in further embodiments of the present invention. And, FIG. 9*a*: illustrates an apex cap piece for use with the roof tile edge covers of the present invention;

FIG. 9*b*: is an illustration of FIG. 9*a* having covers inserted in the apertures, and FIG. 9*c* is another illustration of FIG. 9*a* with the parts at the apex cap moved relative to one another.

Referring now to FIGS. 1 to 3 of the accompanying drawings the gable end of a tiled roof 1 is shown with end wall 4 and eaves 5.

The roof 1 is formed from a plurality of interengaging tiles 2, usually of concrete, with ridge caps 3 extending along the apex of the roof 1.

The roof tiles 2 are laid in overlapping stepped rows with adjacent tiles 2A and 2B of a row being shown diagrammatically in FIG. 2 as being interengaged one with the other by means of respective ends 7A and 7B having respective interconnecting edges 10A and 10B in known manner.

Each row of tiles 2 will be laid along respective tiling battens 11 extending between rafters 12, only one end rafter 12 being shown.

The end tiles of each row have their respective edges covered over by respective tile edge covers 8 slid thereover, the topmost covers 8 each engaged within an apex cap member 9 described in detail hereafter with respect to FIG. 9 of the accompanying drawings.

As will be seen from FIG. 2 the side edge 10A of tile 2B overhanging the barge board 6 of the right hand gable has been removed to leave a new tile edge 10C. This removal can be simply achieved by a short sharp blow along the edge as is commonly used by brick layers in the forming of part bricks.

Prior to the laying of the end tile 2B a rail assembly 17 is laid along the length of the barge board 6 over the end rafter 12 and the plurality of tiling battens 11. The barge board 6 is flush with the top of the tile batten 11, a further short piece of batten 11 (not shown) being required behind the fascia board so as to support the end of the rail assembly 17, the bottom course or row of tiles 2 then being set out in such a manner as to maintain an even overhang to the gables.

One of the covers 8 can then be slid over the tile end 10C with one of its inturned edges 13A engaging about the tile end 10C and a bottom inturned edge 13B engaging a downturned lip 20 of the rail assembly 17. The downturned lip 20 of the rail assembly 17 is shown at the end of an overhang from a substantially flat rail part 18 which is secured by nails 19 to the tiling battens 11 and barge board 6.

Each cover 8, as will be seen particularly in FIG. 3, has a web 14 of diminishing width and in this embodiment along both edges of the web 14 inturned lips 13A and 13B defining a large opening 16 at a first end of the cover 8 and a small opening 15 at a second end of the cover 8.

Whilst for ease of reference thereto in the description the top and bottom lips 13 have been referred to separately as 13A and 13B it is to be understood that the covers 8 are in fact symmetrical about their longitudinal axes there being no difference between the two inturned lips 13A and 13B. This has the very important advantage that only one design of cover 8 is required for use at either end and on either side of the roof 1 i.e. the previous requirement for left and right hand components for the tile fixing system is done away with thus substantially reducing the inherent production costs of these covers 8.

The bottom most row of tiles will normally rest on the top of the fascia board which is above the incline of the roof so as to give to this bottom row or course of tiles 2 the desired angle relative to the roof incline. This incline will be subsequently taken up by the next row of tiles resting on the bottom row and thus as will be seen particularly from FIG. 1 the roof 1 will progress in a series of steps between the adjacent rows of tiles. Over each end tile of a row a cover 8 will be slid with its inturned lip 13A engaging the tile end 10C and its bottom inturned lip 13B engaging the downturned lip 20 of the rail 17. As will be apparent again from FIG. 1 the covers 8 are slid over the end tiles larger end 16 first, with the larger end 16 then overlapping the smaller end 15 of the next lower cover 8 by an amount equivalent to the overhang of the tiles of the respective rows. This overlapping will generally be of the order of 75 MM, and provides a double thickness of the material of the overlapping covers 8 locked into the rail lip 20 which results in a complete rigidity for the assembled covers.

As each cover 8 is substantially equal in length to the length of a tile 2, as will be seen from FIG. 1 the covers 8 do not detract from the end appearance of the resulting roof 1 and the stepped nature of the subsequent tile rows is retained.

The aforementioned sliding of the covers 8 over the already positioned end tile 2 is replaced by the springing in of the top tile 2 on one side only, the roof 1 above the top tile 2 being finished off by the ridge caps 3 and the apex caps 9 into which the top covers 8 are inserted as will hereinafter be described.

It is desirable to ensure that water cannot enter into the roof over the barge board 6 and for this purpose waterproofing of any suitable type may be necessary.

In FIGS. 4*a* and 4*b* the rail assembly 17 of FIG. 2, including the flat part 18 nailed by means of nails 19 to the barge board 6 and tiling battens 11, includes waterproofing between the rail assembly 17 and the barge board 6 which in FIG. 4*a* comprises a beaded strip 21 having a bead 23 and a flat portion 22 squashed between the rail 17 and barge board 6 and nailed in position, the beaded strip being of any suitable material, for example plastics; whilst in FIG. 4*b* there is shown as another example a bead 25 of suitable material, for example mastic or the like, secured in position along the underside of the rail 17 against the barge board 6 by nails 26 through a quarter round wooden bar 24.

Referring now to FIG. 5 of the accompanying drawings an alternative form of rail assembly 17A is shown in which the substantially flat part 18A thereof has been turned through substantially 90° and is shown nailed by means of nails 28 to the vertical face of the barge board 6. The rail assembly 17A is also shown provided with a plurality of downturned lips 20A which may be provided to give a desired tolerance on either side of the roof, it being appreciated in this regard that by the provision of a plurality of lips 20A the bottom inturned lip 13B of the covers 8 can then engage within the lip 20A which is appropriate to the overhang of the tile edge.

Referring now to FIG. 6 of the accompanying drawings a further alternative form of rail assembly 17B is shown in which the flat portion thereof 18B is again secured by nailing to the tiling battens 11. In the example shown the rail assembly 17B again has a plurality of downturned lips 20B for the purpose hereinbefore described with reference to the embodiment of FIG. 5. Also the barge board 6 is shown as not being flush with the top of the tiling battens 11 and the rail 17B has a short flat portion 27 which is at a lower level than the major flat portion 18B. It is believed that this may be of advantage in providing an internal channel or gutter along which any water passing over the rail assembly 17B can be carried away.

The portion 18B is also shown as including a plurality of slots which will correspond in their spacing along the portion 18B with the spacing of the tiling battens 11. The slots 29 will increase the aforementioned tolerance equivalent to the length of the slot 29 which will have nails 30 inserted therethrough at either end thereof once the desired overhang of the end roof tiles 2 from the barge board 6 has been accommodated.

With reference now to FIG. 7 of the accompanying drawings rather than providing a rail assembly 17 along the length of the barge board 6 in this embodiment of the invention the covers 8A also fulfil the function of the previously described rail assembly 17. The covers 8A include the web 14A having a width diminishing between the large end 16A and the small end 15A with an inturned upper lip 13A'. However, along its bottom edge the web 14A has a substantially flat portion which in use will lie over the barge board 6 and the tiling battens 11. Any suitable means for securing the portion 31 in position can be provided although in the example shown in FIG. 7 a slot 32 will be slid over upstanding locking members provided for this purpose on the tiling battens 11 and/or the barge board 6. Other ways of securing the cover/rail members 8A in position will be readily apparent to those skilled in the art.

Referring now to FIG. 8 a further embodiment of rail assembly 17C is shown once again secured by means of nails 19 over the tiling battens 11, barge board 6 and rafter 12. However the substantially flat portion 18C is shown in this example as having an upturned inner lip 33 which it is believed may be desirable so as to ensure that water does not pass over the rail assembly 17C beneath the tiles 2. The rail assembly 17C is also shown in this Figure as having only a single downturned lip 20C and also including the water proofing bead strip arrangement 21 of preceding FIG. 4A.

In FIG. 8 there is also shown an example of a further embodiment of cover 8C in which the inturned lips 13C at the larger end 16C have a chamfered edge 34, it being considered that the sharp corners resulting from the embodiment shown in FIG. 3 possibly being undesirable. As a further alternative it is considered that the corners of inturned lips 13C could be radiused so as to take away the sharp corners.

Referring now to FIGS. 9 an apex cap 9, previously shown in FIG. 1, is shown as having two parts 36 and 37 which can be folded together from the position shown in FIG. 9*a* about a folding line 35. Each of the parts 36 and 37 has an outer edge 38 at a top part of which is provided an aperture 39 to accommodate respective small ends of the covers 8. Thus, in FIG. 9*b* a pair of covers 8 are shown as having been inserted into the respective apertures 39 whilst in FIG. 9*c* with the parts 36 and 37 moved relative one with the other to accommodate the slope of the roof 1 the cap 9 together with the covers 8 is shown in position on the roof 1.

As will be more readily apparent from FIG. 1 the rear face of the apex cap 9 can accommodate the end of one of the ridge caps 3 and also the top portions of the two top corner tiles 2.

It is to be understood that the various embodiments of the invention described by way of example with reference to the accompanying drawings are mutually inclusive wherever appropriate such that for example the cover 8C of FIG. 8 could if desired be used with the rail assembly 17 of FIG. 2 and including the waterproofing by the use of the mastic bead assembly as shown in FIG. 4*b*.

The material(s) used for the covers 8 and rail assembly 17 hereinabove described can be any that are considered suitable for the purpose and corrosion proofed metal plate or even plastics for example P.V.C. are mentioned by way of example.

Where in the aforegoing description reference has been made to specific components or integers of the invention which have known equivalents in the art to which this invention relates then such known equivalents are herein incorporated as if individually set forth.

Although this invention has been described by way of example and with reference to possible embodiments thereof it is to be understood that modifications or improvements may be made thereto without departing from the scope of the invention as defined in the appended claims.

I claim:

1. A roof tile edge cover assembly comprising a roof tile edge cover having an elongate web of diminishing width along its length said web having along both edges thereof an inwardly directed lip, said lips defining a large and a small opening at respective first and second ends of said web, a rail assembly to the roof edge, and wherein the large opening at the first end of one of said covers is slid over the edge of an end tile of one row and over the second end of a cover already in position over the edge of an end tile of the adjacent lower row with the inwardly directed lips of the covers engaged respectively along the respective tile edges and the downturned lip of the rail assembly such that the covers are secured to the roof edge and the interconnection of the respective covers of adjacent rows secures the rows together.

2. A roof tile edge cover assembly as recited in claim 1, in which the rail assembly has a plurality of said downturned lips substantially parallel one with the other, one of the inwardly directed lips of the respective covers being engaged along one of said downturned lips appropriate to the overhang of the tile edges from the roof edge.

3. A roof tile edge cover assembly as recited in claim 1, wherein said rail assembly further includes along an opposite edge from said downturned lip an upturned lip which prevents any water passing over the rail assembly from entering any further beneath the rows of tiles.

4. A roof tile edge cover assembly as recited in claim 1, in which a sealing means is provided between said rail assembly and said roof edge to prevent entry of water beneath the tiles.

5. A roof tile edge cover assembly as recited in claim 1, further comprises an apex cap member which accommodates in respective side portions thereof one of said tile edge covers and in which said side portions are moved relative one with the other to accommodate the incline of the sides of the roof.

* * * * *